US006404994B1

(12) United States Patent
Kawai et al.

(10) Patent No.: US 6,404,994 B1
(45) Date of Patent: Jun. 11, 2002

(54) IMAGE FORMING APPARATUS AND SYSTEM

(75) Inventors: Atsushi Kawai, Tokokawa; Masazumi Ito, Toyohashi, both of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/604,268

(22) Filed: Jun. 26, 2000

(30) Foreign Application Priority Data

Jun. 29, 1999 (JP) ..... 11-183939
Jun. 30, 1999 (JP) ..... 11-185878

(51) Int. Cl.[7] ..... G03G 15/00; G03G 15/04; G03G 15/22; G03G 15/36

(52) U.S. Cl. ..... 399/6; 399/194

(58) Field of Search ..... 399/1, 2, 3, 4, 399/6, 194; 347/112

(56) References Cited

U.S. PATENT DOCUMENTS 5,030,995 A * 7/1991 Bolton ..... 399/194
5,331,375 A * 7/1994 Ito ..... 399/6
5,386,270 A * 1/1995 Housel ..... 399/6
5,742,879 A * 4/1998 Altrieth, III ..... 399/194 X
5,974,548 A * 10/1999 Adams

FOREIGN PATENT DOCUMENTS

JP 8-256256 10/1996

* cited by examiner

*Primary Examiner*—Sandra Brase
(74) *Attorney, Agent, or Firm*—McDermott, Will & Emery

(57) ABSTRACT

A copying machine with a charging device that can substantially improve the advertisement effect in case of printing by adding an additional image to a document image. This copying machine, when the set registered number is plural, changes the kind of advertisement images to be printed every time a document is exchanged. It also changes the kind of advertisement images depending on whether or not a copying mode is a color copy. In particular, if it is the color copy, the above-mentioned changeover is done in accordance with a function mode and/or a document mode, which are detail modes of the color copy. This copying machine also displays a plurality of printable selection candidates from a plurality of advertisement images stored in advance and makes a user on his/her own select an advertisement image to be printed. In this case, a selection condition of the advertisement image by the user (kind or order of the selection candidates to be displayed, or number of selectable advertisement images, for example) is changed in accordance with an environment when the user copies the document (copying mode, current time, or installation location, for example).

22 Claims, 13 Drawing Sheets

| SEX \ AGE | ≦ 19 | 20–39 | 40–59 | 60 ≦ |
|---|---|---|---|---|
| MALE | A | C | E | G |
| FEMALE | B | D | F | H |

IMAGE FORMING APPARATUS AND SYSTEM

This application is based on Japanese Patent Application No. 11-183939 filed on Jun. 29, 1999 and Japanese Patent Application No. 11-185878 filed on Jun. 30, 1999, the contents of which are hereby incorporated by reference.

BACKGROUND OF THE INVENTION

1. Field of the Invention

This invention relates to an image forming apparatus and system for printing by adding an additional image such as advertisement image to a document image.

2. Description of Related Art

With ever-increasing popularity of copying machines in recent years, many copying machines equipped with a charging device have been installed in such places as convenience stores. Since these copying machines are used by a number of unspecified users, an advertiser can expect a certain meaningful advertisement effect if advertisement image information is added during copying operations.

That being the case, there have been numerous propositions for such an image forming apparatus, which consists of a basic copying unit capable of adding an advertisement image to a blank area that occurs in printing a scanned document image on a sheet of paper and is adapted to charge both user and advertiser if a copy is made with the advertisement image added to the scanned document image.

As an example, such an image forming apparatus is known (refer to JP,8-256256,A), which is designed to obtain a substantial advertisement effect more efficiently by having a sorting means for sorting a plurality of additional images (advertisement images) held in the apparatus according to a category based on time or environment (such as a place of installation of the apparatus), automatically selecting an additional image within the category that matches with the time when the additional image was requested or the environment of the image forming apparatus that requested the additional image in selecting the additional image to be transmitted, and outputting an image obtained by synthesizing the particular additional image with the document image at the time or place most suitable for the contents of the additional image.

However, in the image forming apparatus disclosed in the above publication, there is a limitation to the level of improvement of the advertisement effect, as it does not always provide useful advertisement images for users in reality since the switching of the advertisement image to be printed occurs automatically depending on time or environment assuming a number of unspecified users, i.e., without any consideration to individual users. In other words, the conditions such as time and environment have little relevance on actual individual users, so that we must conclude that the probability of selecting in reality a suitable advertisement image for an actual user is low if the selection is made only on those conditions.

SUMMARY OF THE INVENTION

It is an object of this invention to provide an image forming apparatus and system which are capable of substantially increasing the advertisement effect in case of printing by adding an additional image such as advertisement image to a document image.

According to an aspect of the invention, an image forming apparatus comprises a selecting unit for selecting a condition from a plurality of conditions, a memory for storing a plurality of additional images, a control unit for outputting from the memory an additional image in accordance with the selected condition, and an image forming unit for forming an image by adding the outputted additional image to a document image.

According to another aspect of the invention, an image forming apparatus comprises a memory for storing a plurality of additional images, a display unit for displaying information corresponding to part of additional images of the plurality of additional images stored in the memory, a selection unit for making a user select an additional image to be image-formed from of the part of additional images based on the displayed information, and an image forming unit for forming an image by adding the selected additional image to a document image.

According to still another aspect of the invention, an image forming apparatus comprises a memory for storing a plurality of additional images, a receiving unit for receiving a signal of selecting an additional image to be image-formed from the plurality of additional images stored in the memory, and an image forming unit for forming an image by adding to a document image the additional image selected based on the received signal.

According to a further aspect of the invention, an image forming system comprises a memory for storing a plurality of additional images, an image forming unit for forming an image by adding a selected additional image to a document image, an output device for outputting a selection signal of selecting an additional image to be image-formed from the plurality of additional images stored in the memory, the output device being installed at a location away from the image forming unit, a receiving unit for receiving the outputted selection signal, and a control unit for controlling the image forming unit so as to form an image by adding to a document image the additional image selected based on the received selection signal.

According to a still further aspect of the invention, an image forming apparatus comprises a memory for storing a plurality of additional images, a receiving unit for receiving a signal of displaying information corresponding to part of additional images of the plurality of additional images stored in the memory, a display unit for displaying the information based on the received signal, a selection unit for making a user select an additional image to be image-formed from the part of additional images based on the displayed information, and an image forming unit for forming an image by adding the selected additional image to a document image.

According to a yet further aspect of the invention, an image forming system comprises a memory for storing a plurality of additional images, an image forming unit for forming an image by adding a selected additional image to a document image, an output device for outputting a display signal of displaying information corresponding to part of additional images of the plurality of additional images stored in the memory, the output device being installed at a location away from the image forming unit, a receiving unit for receiving the outputted display signal, a display unit for displaying the information based on the received display signal, a selection unit for making a user select an additional image to be image-formed from the part of additional images based on the displayed information, and a control unit for controlling said image forming unit so as to form an image by adding the selected additional image to a document image.

According to a yet further aspect of the invention, an image forming apparatus comprises a memory for storing a plurality of additional images, an accepting unit for accepting user information for selecting an additional image to be image-formed from the plurality of additional images stored in the memory, and an image forming unit for forming an image by adding to a document image the additional image selected based on the accepted user information.

According to a yet further aspect of the invention, an image forming apparatus comprises a memory for storing a plurality of additional images, an accepting unit for accepting user information for displaying information corresponding to part of additional images of the plurality of additional images stored in the memory, a display unit for displaying the information based on the accepted information, a selection unit for making a user select an additional image to be image-formed from the part of additional images based on the displayed information, and an image forming unit for forming an image by adding the selected additional image to a document image.

DESCRIPTION OF THE PREFERRED EMBODIMENTS

Various embodiments of the invention will be described below by reference to the above-mentioned accompanying drawings.

Figure 1:
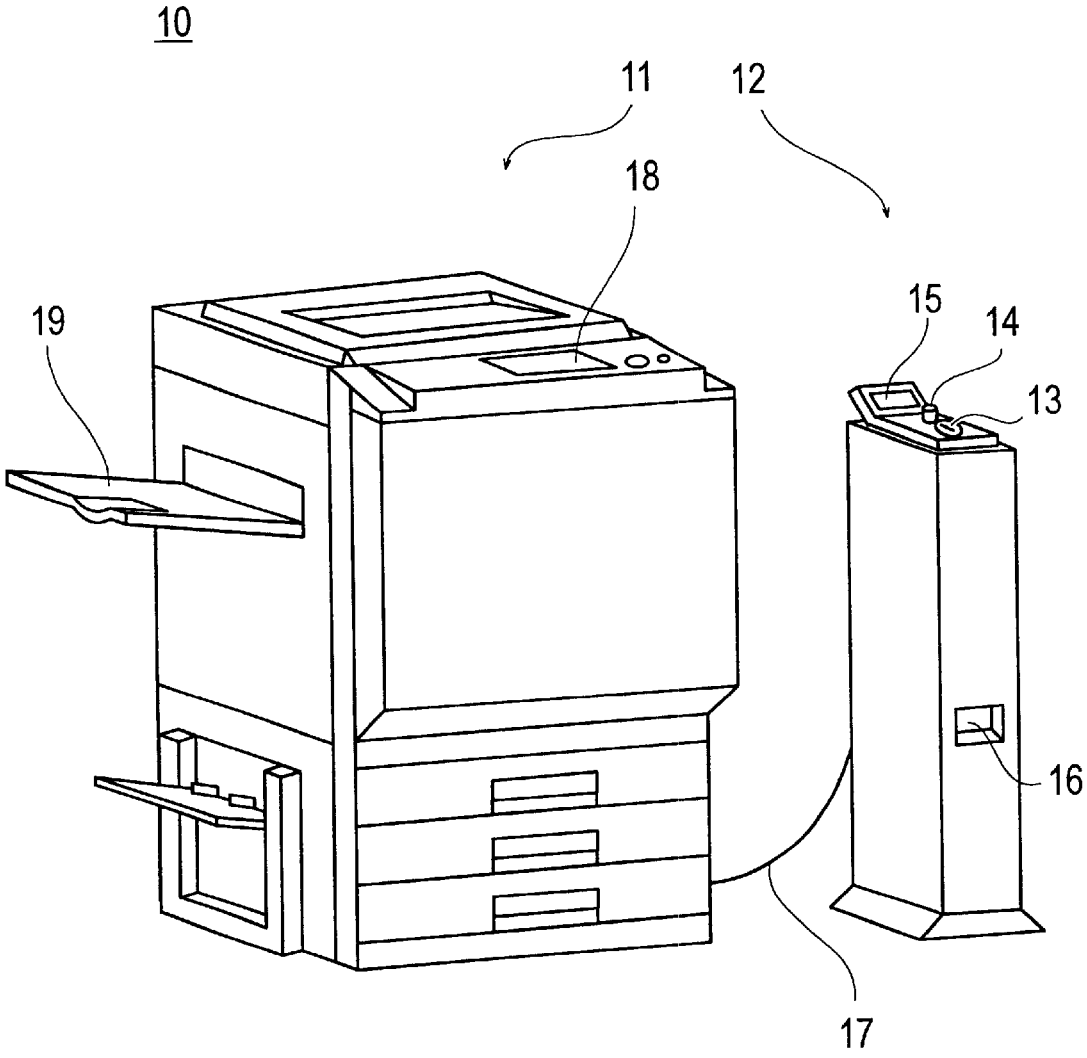
FIG. 1 is a perspective view of the total construction of a typical image forming apparatus according to this invention.

FIG. 1 is a perspective view of the total construction of a typical image forming apparatus according to this invention.

The image forming apparatus 10 shown in FIG. 1 is a copying machine (or copying apparatus) equipped with a charging device to be used by a number of unspecified users typically installed at a convenience store, and basically comprises a basic copying unit 11 and a charging device 12. The charging device 12 shown in the figure is a coin-operated vending machine, which allows the user to make copies when the user deposit a certain amount of coins into the charging device 12 and operates the basic copying unit 11.

The charging device 12 displays the deposited amount, allows the copying operation of the basic copying unit 11 according to the deposited amount, collects the prescribed amount when the copying operation is completed, and subtracts the same amount from the displayed amount. The amount to be subtracted varies with the paper size that is used for copying, the copying color mode that is set, and so on. The charging device 12 prohibits the copying operation of the basic copying unit 11 when the remaining amount after the copying operation and the subsequent subtraction process is less than the prescribed amount. It may allow a continuation of the copying operation of the basic copying unit 11 if an additional amount is deposited. In this way, the charging device 12 has the function of designating permission/prohibition of the copying operation to the basic copying unit 11 with controlling the amount (usage charge and remaining amount).

Moreover, the charging device 12 is of an elongated box shape, and has on the top surface a coin depositing slot 13, a coin return pushbutton 14 for coin return requests, and an amount display 15 that consists of a liquid crystal display and displays the amount deposited and the remaining amount, as well as, on the front surface, a coin return slot 16. The charging device 12 is connected to the basic copying unit 11 via a relay connector 17 extending from the back surface thereof.

The basic copying unit 11 and the charging device 12 communicate with each other via the relay connector 17. The basic copying unit 11 sends various information such as under copying operation, paper feed signal, paper discharge signal, size, and copying mode, to the charging unit 12. On the other hand, the charging device 12 sends various information such as copying enable, copying disable, and deposited amount, to the basic copying unit 11. The basic copying unit 11 is controlled either to the copy enabled or disabled state based on various information sent or received. An operating panel 18 is provided on the top surface of the basic copying unit 11 to enable the user to set various copying modes each including the registered number (number of sets).

The charging device 12 calculates the necessary amount of money required from the copying mode set by the user on the operating panel 18 of the basic copying unit 11, makes judgment whether to enable or disable the copying based on the calculated amount and the deposited amount, and send the copy-enabling signal to the basic copying unit 11 if it should be allowed to copy. Upon receiving the copy-enabling signal, the basic copying unit 11 sets itself for the user to make copies.

When the user presses a start key (not shown) on the operating panel 18, the basic copying unit 11 starts the copying operation and sends paper discharge information to the charging device 12 when the paper is discharged to a paper discharge tray 19. Upon receiving the paper discharge information, the charging device 12 subtracts from the registered amount a predetermined amount prescribed by the copying mode including size and color. When, as a result of the subtraction of the usage charge each time copying is made, the remaining amount falls below the amount required for copying, the charging device 12 sends the copy-disabling signal to the basic copying unit 11. Upon receiving this copy-disabling signal, the basic copying unit 11 is set to the copy disabled state for the user.

Although it has been assumed that the charging device 12 is coin-operated, it doesn't have to be limited to this type. For example, it can be a charging device that uses an information memory medium such as prepaid card, on which monetary information is recorded.

The copying machine 10 has the capability of printing by adding advertisement images (additional images) to document images at a user's desire. In printing document images added with advertisement images, a second charging device is provided in a memory of the basic copying unit 11, in addition to the charging device 12 for charging the user, so that an accumulated charge can be charged to the advertiser by recording the number of copies made with advertisements for a certain period of time.

Figure 2A:
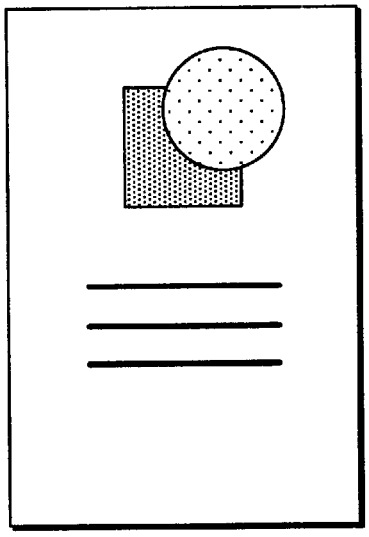
FIGS. 2A–2C are drawings intended for describing various printing formats practiced on the image forming apparatus shown in FIG. 1.
Figure 2B:
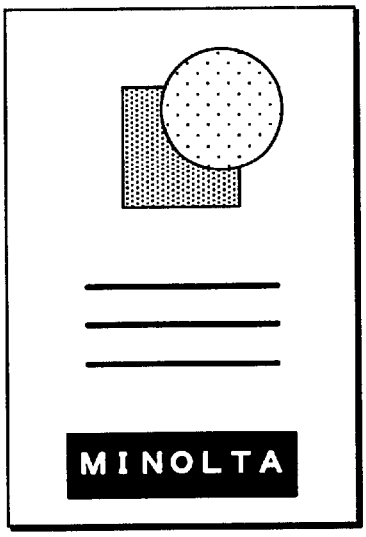
Figure 2C:
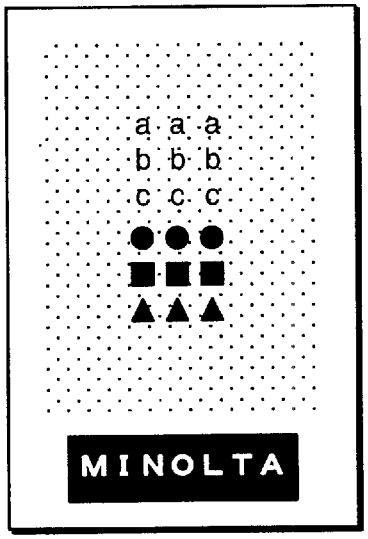

FIGS. 2A–2C are drawings intended for describing various printing formats practiced on such copying machine 10, wherein FIG. 2A is a case where only a document image is printed, FIG. 2B is a case where an advertisement image is printed on a blank area of the document image, and FIG. 2C is a case where an advertisement image is printed either on the back of the paper on which the document image was printed or on a separate sheet of paper.

In other words, the copying machine 10 can print, in addition to a document image only as shown in FIG. 2A, an advertisement image on a blank area or the back of the paper on which the document image was printed, or on a separate sheet of paper as shown in FIG. 2B or FIG. 2C at the desire of the user. More specifically, if no advertisement image is to be printed, only the document image will be printed as shown in FIG. 2A. If an advertisement image is to be printed in the blank area, the blank area will be automatically detected and the advertisement image will be printed in the detected blank area (bottom area of the paper as shown in the indicated example) as shown in FIG. 2B. If an advertisement image is to be printed on the back or on a separate sheet of paper, a large advertisement image will be printed on the back of the paper on which the document image was printed or on the separate sheet of paper over its whole page as shown in FIG. 2C. The user can arbitrarily set whether or not to perform advertisement printing, and, if advertisement printing is to be performed, whether an advertisement image is to be printed on the blank area (blank area advertisement), on the back (backside advertisement) or on a separate sheet of paper (separate sheet advertisement).

Figure 3:
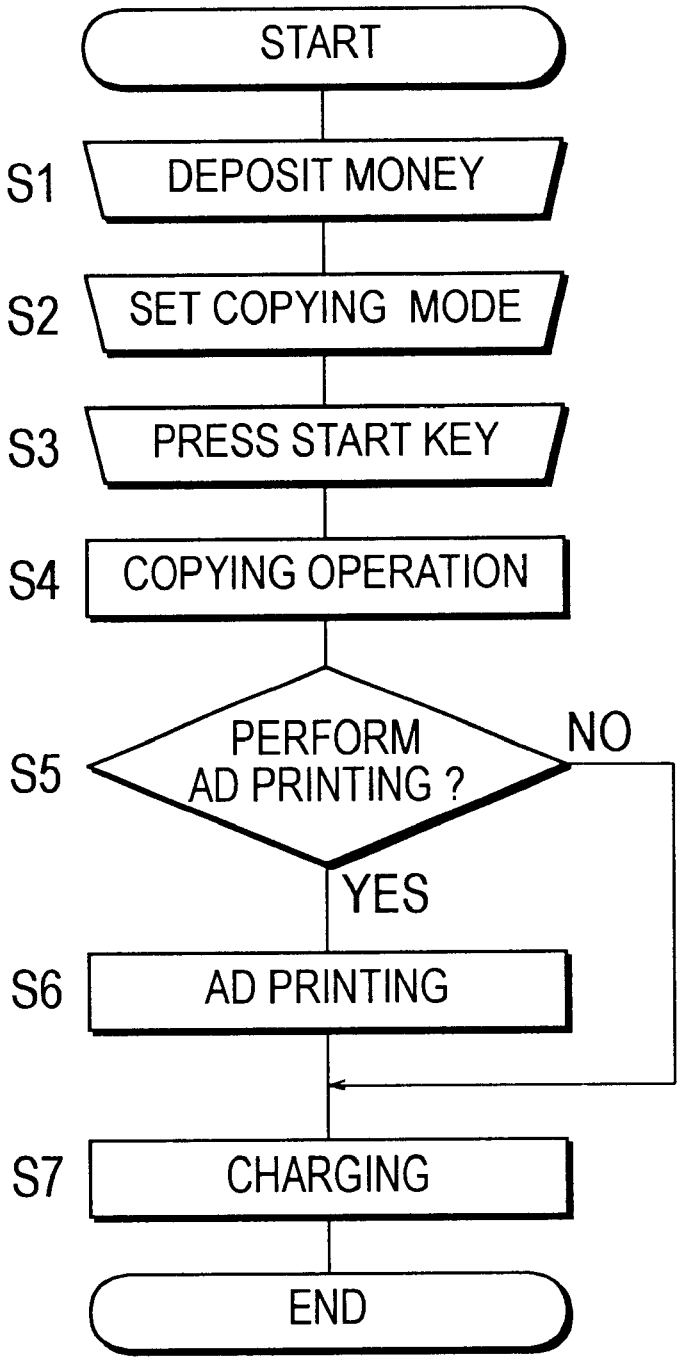
FIG. 3 is a basic flow chart showing the general procedure for conducting advertisement printing in the image forming apparatus shown in FIG. 1.

FIG. 3 is a basic flow chart showing a general procedure for advertisement printing in the copying machine 10.

Let us assume that the copying machine 10 is installed in a convenience store, for example. An unspecified user deposits coins in the charging machine 12 (S1), and the user sets a copying mode through the operating panel 18 of the basic copying unit 11 (S2). At this time, the user can also set various settings concerning advertisement printing.

When the user presses the start key after these settings (S3), the copying operation starts (S4), and a judgment is made whether or not to perform advertisement printing (S5). If no advertisement printing is to be performed (S5:NO), it proceeds directly to the step S7; if advertisement printing is to be performed (S5:YES), the advertisement printing is performed (S6). Although the decision whether or not to perform the advertisement printing at the step S5 is made based on the information set by the user during the copying mode setting at the step S2 in this embodiment, the invention is not limited to it, but rather there can be a case where the device automatically makes the decision mentioned above based on such information as copy condition and apparatus environment. Moreover, the advertisement printing at the step S6 is performed by having a plurality of advertisement images stored in the basic copying unit 11 in advance and printing an advertisement image automatically selected by a method to be described later on the blank area of the copying paper (blank area advertisement), or on the back of the copying paper (backside advertisement), or on a separate sheet of paper from the copying paper (separate sheet advertisement).

When a series of copying operation (including advertisement printing if advertisement printing is performed) is completed, the aforementioned charging process is conducted based on the money deposited in the charging device 12 (S7). The charging process at this time is the charging for the user, while a charge is also charged to the advertiser if advertisement printing has been conducted. The charge for the advertiser, as stated above, is done in a lump sum for a certain period of time based on the record of advertisement printing for the period recorded in the memory of the basic copying unit 11.

Figure 4:
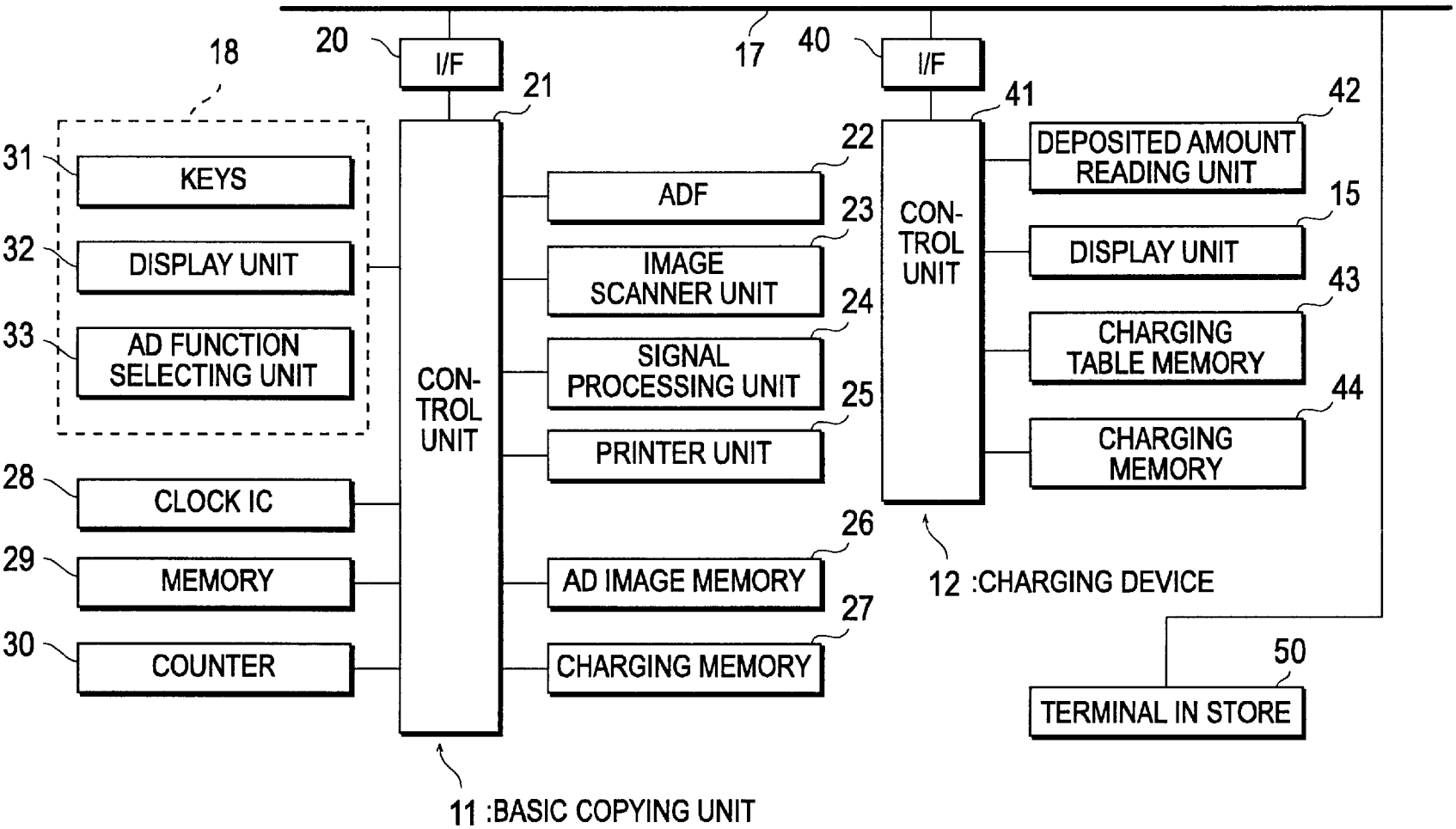
FIG. 4 is a block diagram showing a constructional example of the control system of the image forming apparatus shown in FIG. 1.

FIG. 4 is a block diagram showing a constructional example of the control system of such copying machine 10.

The copying machine 10 comprises the basic copying unit 11 and the charging device 12 that are capable of communicating with each other via the relaying connector 17 and input/output interfaces (I/Fs) 20 and 40. A control unit 21 of the basic copying unit 11 is connected to an automatic document feeder (ADF) 22 that feeds a plurality of sheet documents automatically sheet by sheet to a document set position on a platen (not shown) and stores the document on the discharge tray 19 automatically after the end of the exposure process, an image scanner unit 23 that scans a document image, a signal processing unit 24 that processes image data signals outputted from the image scanner unit 23, a printer unit 25 for printing the image that corresponds to the document image on a paper, and the operating panel 18 mentioned above. The control unit 21 is further connected to an advertisement image memory 26 that stores a plurality of advertisement images in advance, a charging memory 27 that stores the number of advertisements printed and the charge for the advertiser cumulatively, a clock IC 28 for timing the current time and date, a working memory 29 used for temporarily storing image data or for synthesizing images, and a counter 30 for counting the number of advertisements printed. The control unit 21 is in charge of controlling various parts of the basic copying unit 11 as well as its communication with the charging device 12.

By storing charges to the advertiser cumulatively in the charging memory 27, it is possible to obtain a lump sum information for a prescribed period. The amount of money cumulatively stored is the charge to the advertiser, and this amount is charged to the advertiser in a lump sum for a certain period.

The operating panel 18 is equipped with various keys 31, a display unit 32, and an advertisement function selecting unit 33. various keys 31 include, for example, register keys for setting the number of sets, keys for setting a color mode (color copy/monochromatic copy) for printing the document image, keys for setting a function mode (e.g., normal mode, photograph copying mode, enlarging serial shooting mode, book division mode, etc.) as a detail mode of the color copy, keys for setting a document mode (e.g., character, character/photograph, photograph, map, etc.) as another detail mode of the color copy, keys for selecting or setting the remainder of the copying mode (e.g., double sided copy, enlargement/reduction copy, etc.), a start key for starting the copying operation, and so on. The display unit 32 is composed of, for example, a touch panel type liquid crystal display, and displays the set state, a list of printable advertisements, and other printing information.

The advertisement function selecting unit 33 is used by the user to set whether or not any advertisement printing is to be performed or to set the advertisement printing mode, if the copying machine 10 has a function of automatically selecting an advertisement image to be printed (to be described later in detail). In other words, the advertisement function selecting unit 33 in this case is equipped with keys for setting whether or not any advertisement printing is to be performed, and keys for selecting which mode of the blank area advertisement, the backside advertisement or the separate sheet advertisement is to be used when advertisement printing is to be performed. The advertisement function selecting unit 33 is also used by the user for setting whether or not any advertisement printing is to be performed, selecting an advertisement image to be printed from a plurality of advertisement images displayed (selection candidates), or selecting to print only an advertisement image without printing a document image, if the copying machine 10 has a function of automatically selecting and displaying a plurality of advertisement images (selection candidates) that can be printed, from which the user can arbitrarily select an advertisement image to be printed (to be described later in detail). In other words, the advertisement function selecting unit 33 in this case has keys for setting whether or not any advertisement printing is to be performed, keys for selecting which mode of the blank area advertisement, the backside advertisement or the separate sheet advertisement is to be used, and keys for selecting a desired advertisement image from a plurality of advertisement images displayed (selection candidates). In either case, the keys of the advertisement function selecting unit 33 are constructed as touch panel type keys, for example. In this case, this touch panel type advertisement function selecting unit 33 can be identical with the display unit 32 or a part of it, which is also of touch panel type as mentioned above.

On the other hand, the control unit 41 of the charging device 12 is connected to the aforementioned display unit 15, as well as to a deposited amount reading unit 42 for reading the amount the user deposited, a charging table memory 43, and a charging memory 44 for storing the number of copies and the charge for the user cumulatively. The control unit 41 is in charge of controlling various parts of the charging device 12 as well as its communication with the basic copying unit 11.

The charging table memory 43 stores a table of charge amount for the user and the advertiser respectively according to the copying productivity, a table of charge amount according to the detailedness of the contents of advertisement images, a table of charge amount according to the combination of a color mode of the document image and a color mode of the advertisement image, and so on. The control unit 41 charges the user and the advertiser respectively, referring to appropriate tables in accordance with the specific copying operation executed.

The copying machine 10 is connected to a terminal 50, which is installed in a specific place in the store in which the copying machine 10 has been installed (e.g., at a cash register which is away from the copying machine 10 but from where a salesclerk can still watch a user). The salesclerk can check the current status of the basic copying unit 11 such as, for example, the number of sheets left and the remaining amount of toner, the advertisement printing usage conditions, and the charges to the advertisers, by operating this terminal 50 at the cash register. Moreover, it is also possible for the salesclerk to change manually by remote control the contents of the advertisement images to be printed, or the contents of the advertisement images to be displayed that the user can select (selection candidates), depending on the user's age, sex, profession, and so on.

If the charge is entered by a prepaid card, not by coins, it is also possible to change the contents of the advertisement images to be printed, or the contents of the advertisement images to be displayed that the user can select (selection candidates), based on. the user's personal information such as age, sex, and profession, by reading said information prerecorded in the prepaid card through the charging device 12 and sending it to the basic copying unit 11.

It is also possible to connect, via a network (not shown), the copying machine 10 to a terminal in a central control facility that controls these copying machines 10 installed at a plurality of stores. In this case, it is possible at the central control facility to summarize the operating conditions of each copying machine 10, charge the advertiser by compiling the charging information from each copying machine 10 to charge the particular advertiser in a lump sum, or switch periodically by remote control the advertisement images stored in each basic copying unit 11.

Now, two cases classified roughly will be described separately in the following, one being a case where the copying machine 10 has a function of automatically selecting an advertisement image to be printed, and the other being a case where the copying machine 10 has a function of automatically selecting and displaying a plurality of advertisement images (selection candidates) that can be printed, from which the user can arbitrarily select an advertisement image to be printed.

First, let us describe the former case (embodiments 1–4).

In the embodiments 1–4, it is so arranged that the kind of advertisement images to be automatically selected for printing is switched properly according to a copying mode that a user has set. More specifically, it is arranged to print advertisements that are more appropriate to the user who makes copies and further, if it is expected that the user is going to distribute the copies, to provide advertisements that are more appropriate to the destributional destination of the copies by printing the same set of advertisements (a different advertisement for a different document) for each distributional destination, by selecting and switching the kind of advertisement images to be printed, considering the conditions that can specify to a certain extent the user's age, sex, profession, hobbies, targets of interests, and so on, for example, color mode or not (color copy or monochromatic copy), or, if in case of color copy, contents of a function mode as a detail mode thereof (e.g., normal mode, photograph copying mode, enlarging serial shooting mode, book division mode), or the contents of a document mode as another detail mode thereof (e.g., character, character/photograph, photograph, map), or considering the registered number (number of sets) and document change.

Then, let us describe in turn the specific examples (embodiments 1–4) of the changing control where the advertisement contents to be printed are changed according to the copy mode. The flow charts given below are modifications of the basic flow chart shown in FIG. 3 and any parts that do not need explanations due to the similarities are neither indicated in the drawings nor explained thereon here for the sake of simplicity.

Embodiment 1

Figure 5:
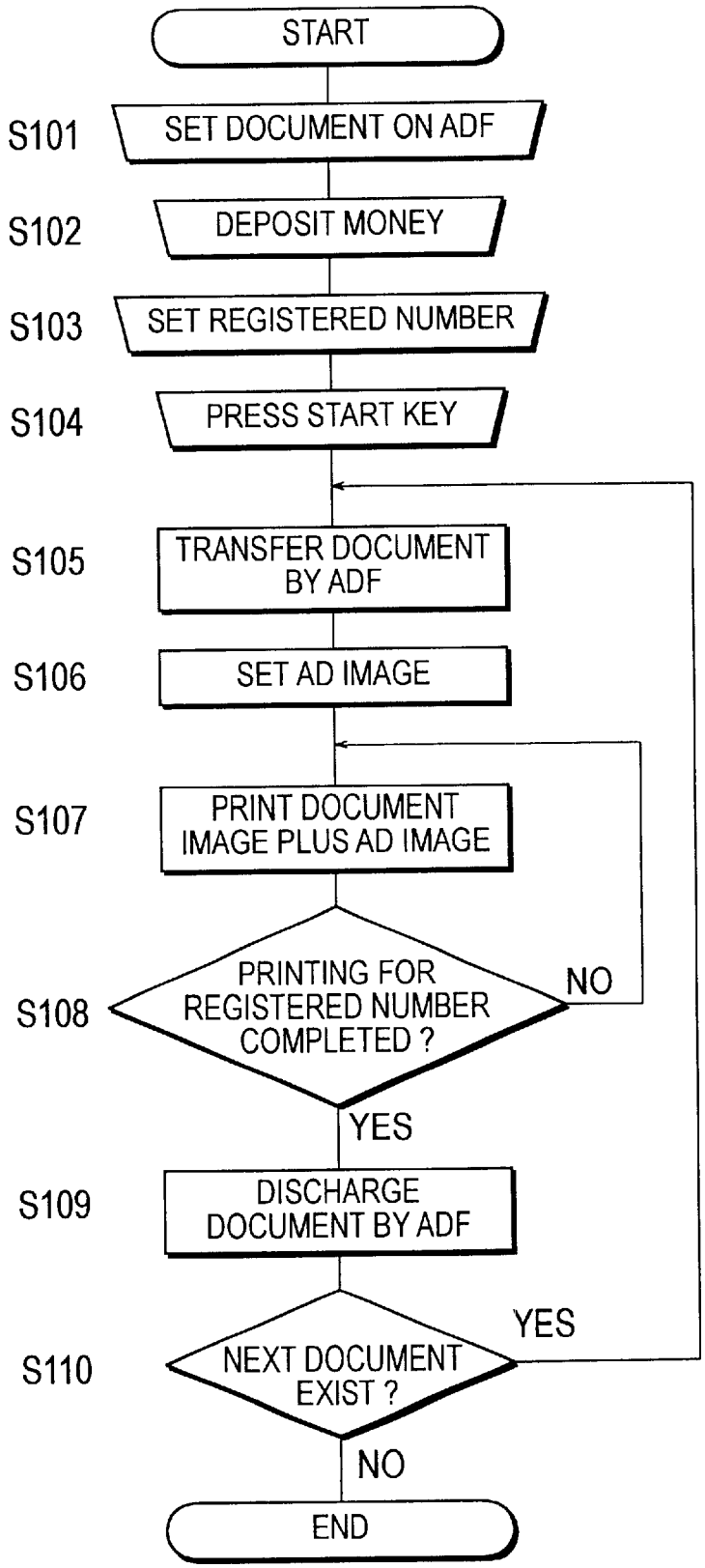
FIG. 5 is a flow chart showing the control procedure for switching the kind of advertisement images by means of switching documents when the registered number is plural in a copying process using an ADF.

The change control shown in the flow chart of FIG. 5 indicates a case where the kind of advertisement images to be printed (selected) are changed according to the change of a document when the registered number (number of sets) is plural in the copying operation using the ADF 22.

The user sets a document on the ADF 22 (S101), deposits money into the charging device 12 (S102), operates the operating panel 18 to set a desired copying mode including the registered number, whether or not to choose the advertisement printing, and so on (S103), and presses the start key on the operating panel 18 to start the copying operation (S104).

When the copying operation starts, the basic copying unit 11 transfers a single sheet of document set on the ADF 22 to the platen of the basic copying unit 11, and reads a document image by the image scanner unit 23 (S105). It then selects automatically one advertisement image from a plurality of advertisement images stored in the advertisement image memory 26 (S106), adds this selected advertisement image to the document image scanned at the step S105, and prints out the result of the addition by the printer unit 25 (S107). At this time, the advertisement image is synthesized such as to the blank area of the copying paper according to the user's setting.

It further judges whether or not the printing for the registered number set at the step S103 is completed (S108), proceeds to the step S109 if it is completed (S108:YES), and returns to the step S107 if it is not completed (S108:NO). In other words, in this case the same document image is printed as many copies as specified by the registered number, and the same advertisement image is printed on all of the copies of the same document. This is because it is considered most likely that the multiple copies are to be distributed to other individuals by the user.

If the printing for the registered number has been completed (S108:YES), the document set on the platen is discharged to the paper discharge tray 19 (S109). If there is a next document on the ADF 22 (S110:YES), the system returns to the step S105 to exchange the document.

When the document exchange is completed (S105), a different advertisement image is set (S106) to add it to the document image for printing (S107). Since a different advertisement image is printed with a different document image as we see here, the number of kinds of advertisements printed in a set of copies increases, so that it is possible to provide effectively a plurality of advertisements for a plurality of individuals including the user even if a wide range of people with different age, sex, profession, and so on are involved when the copies are distributed.

The series of operations from the step S105 through the step S109 is repeated until the document set on the ADF 22 runs out (S110:NO)

Thus, it is possible to achieve a certain appropriate advertisement effect not only to the user himself/herself but also to the distributional destination of the copies since the same set of plural advertisements are printed for the same set of document copies for the registered number (a different advertisement for a different document) by switching the kind of advertisement images each time the document is exchanged when the registered number is plural. In other words, a higher advertisement effect is achieved.

Embodiment 2

Figure 6:
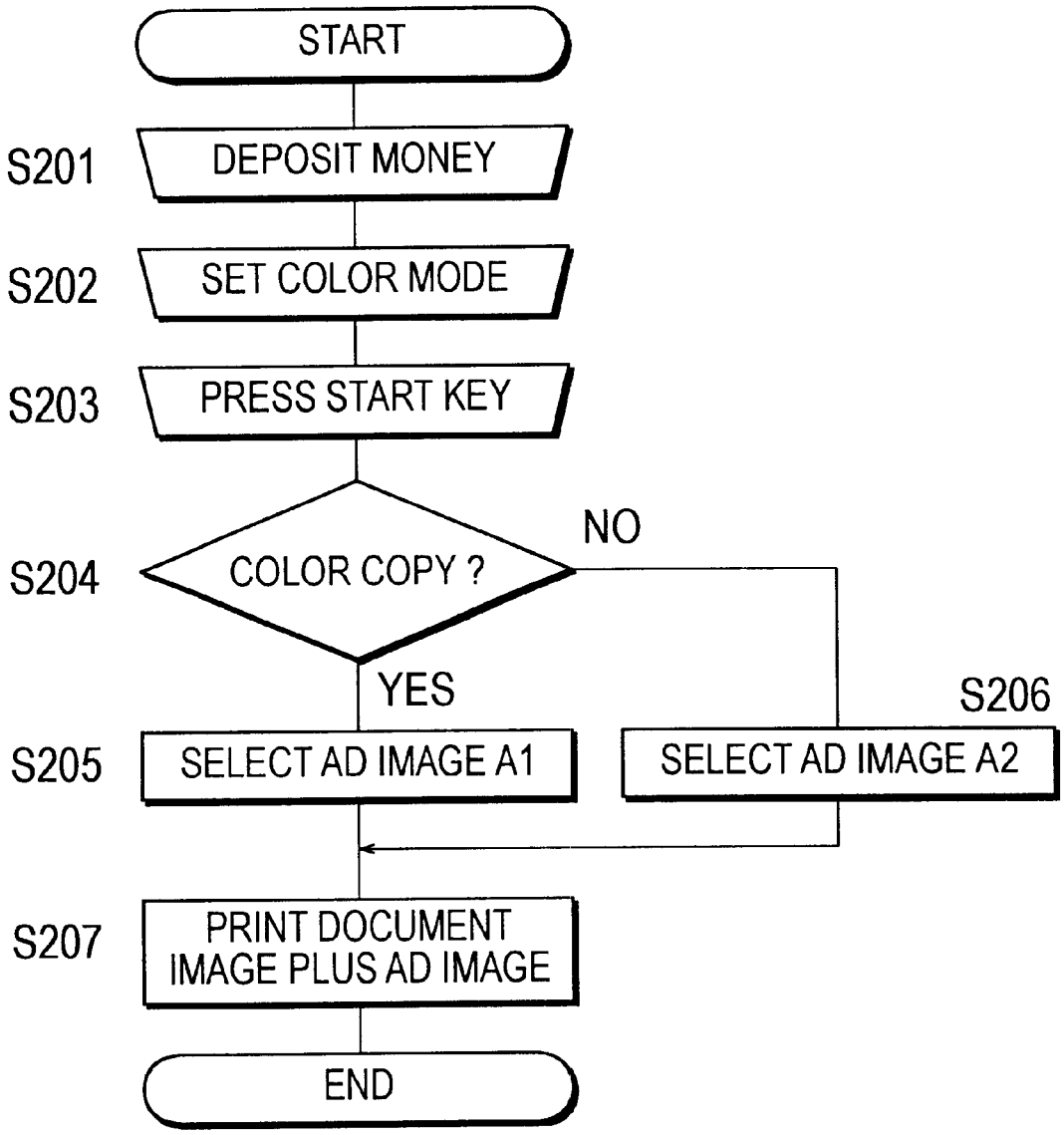
FIG. 6 is a flow chart showing the control procedure for switching the kind of advertisement images according to a color mode.

The change control shown in the flow chart of FIG. 6 is a case where the kind of advertisement images to be printed (selected) are changed according to a color mode.

The user deposits money into the charging device 12 (S201), operates the operating panel 18 to set a desired copying mode including a color mode, whether or not to choose the advertisement printing, and so on (S202), and presses the start key on the operating panel 18 to start the copying operation (S203).

When the copying operation starts, the basic copying unit 11 judges whether or not the color mode set at the step S202 is a color copy (full color) (S204). If it is a color copy (S204:YES), an advertisement image Al for color copy is selected from the two kinds of advertisement images A1 and A2 (A1 for color copy and A2 for monochromatic copy) stored in the advertisement image memory 26 (S205). If it is a monochromatic copy (monochromatic color) (S204:NO), an advertisement image A2 for monochromatic copy is selected (S206). The advertisement image selected at the step S205 or the step S206 is added to the document image for printing (S207). The two kinds of advertisement images A1 and A2 mentioned above are prepared to be suitable for color copy and monochromatic copy respectively.

Embodiment 3

Figure 7:
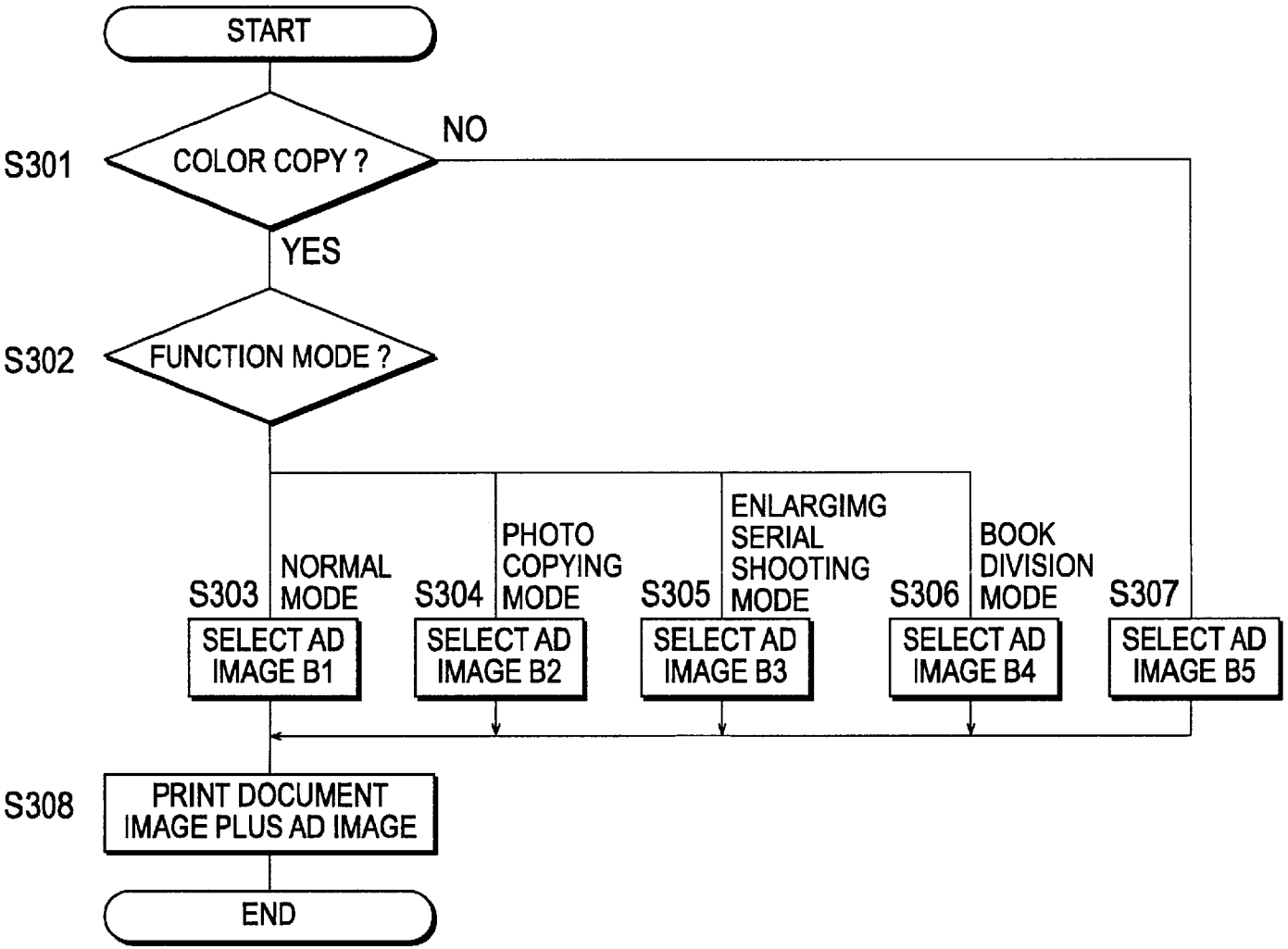
FIG. 7 is a flow chart showing the control procedure for switching the kind of advertisement images according to a detail mode (function mode) of a color copy.

The change control shown in the flow chart of FIG. 7 is a variation of the change control shown in FIG. 6 and is a case where the kind of advertisement images to be printed (selected) are switched according to a color mode in a broad sense in consideration of a detail mode (function mode) of a color copy in addition to the point whether it is a color copy or monochromatic copy.

In other words, a single advertisement image is automatically selected from a plurality of pre-stored advertisement images according to the selected color mode in case where the color mode that can be set by the user is divided into a color copy mode (four kind of function mode, i.e., normal mode, photograph copying mode, enlarging serial shooting mode, and book division mode, are available) and a monochromatic copy mode.

Let us assume that five kinds of advertisement images, for example, an advertisement image related to foodstuff (advertisement image B1), an advertisement image for young women (advertisement image B2), a color print advertisement image (advertisement image B3), a book advertisement image (advertisement image B4), and a newspaper advertisement image (advertisement image B5), are pre-stored in the advertisement image memory 26, and the advertisement image to be printed is automatically selected according to the color mode (including the function mode) set by the user as shown in the flow chart of FIG. 7. For example, the photograph copying mode is colloquially called "purikura" (print club) mode, which is a favorite application of young women, particularly, of high school girls, so that the advertisements suitable for young women (advertisement image B2) are prepared. On the other hand, the book division mode is expected to be used by college students, so that book advertisements (advertisement image B4) are prepared.

Rephrasing the above in further details referring to the flow chart of FIG. 7, the basic copying unit 11 first judges whether or not the color mode set by the user is a color copy (S301). If it is a color copy (S301:YES), the contents of its detail mode (function mode) are further judged (S302). If the function mode is found to be the normal mode, the advertisement image related to foodstuff (advertisement image B1) is selected (S303); if it is found to be the photograph copying mode (print-club mode), the advertisement image for young women (advertisement image B2) is selected (S304); if it is found to be the enlarging serial shooting mode, the advertisement image for color print (advertisement image B3) is selected (S305); and if it is found to be the book division mode, the advertisement image for books (advertisement image B4) is selected (S306). On the other hand, if the color mode happens to be a monochromatic copy (S301:NO), the advertisement image for newspapers (advertisement image B5) is selected (S307). The advertisement image selected severally in the steps S303–S307 is added to the document image for printing (S308).

If the user's attributes such as age, sex, and profession can be specified to a certain degree by means of the color mode including the function mode as indicated above, the chance of printing an advertisement image suited to each specific user becomes higher and the advertisement effect to the user himself/herself who made a copy can be further enhanced by preparing an advertisement image that matches the user's attributes.

Embodiment 4

Figure 8:
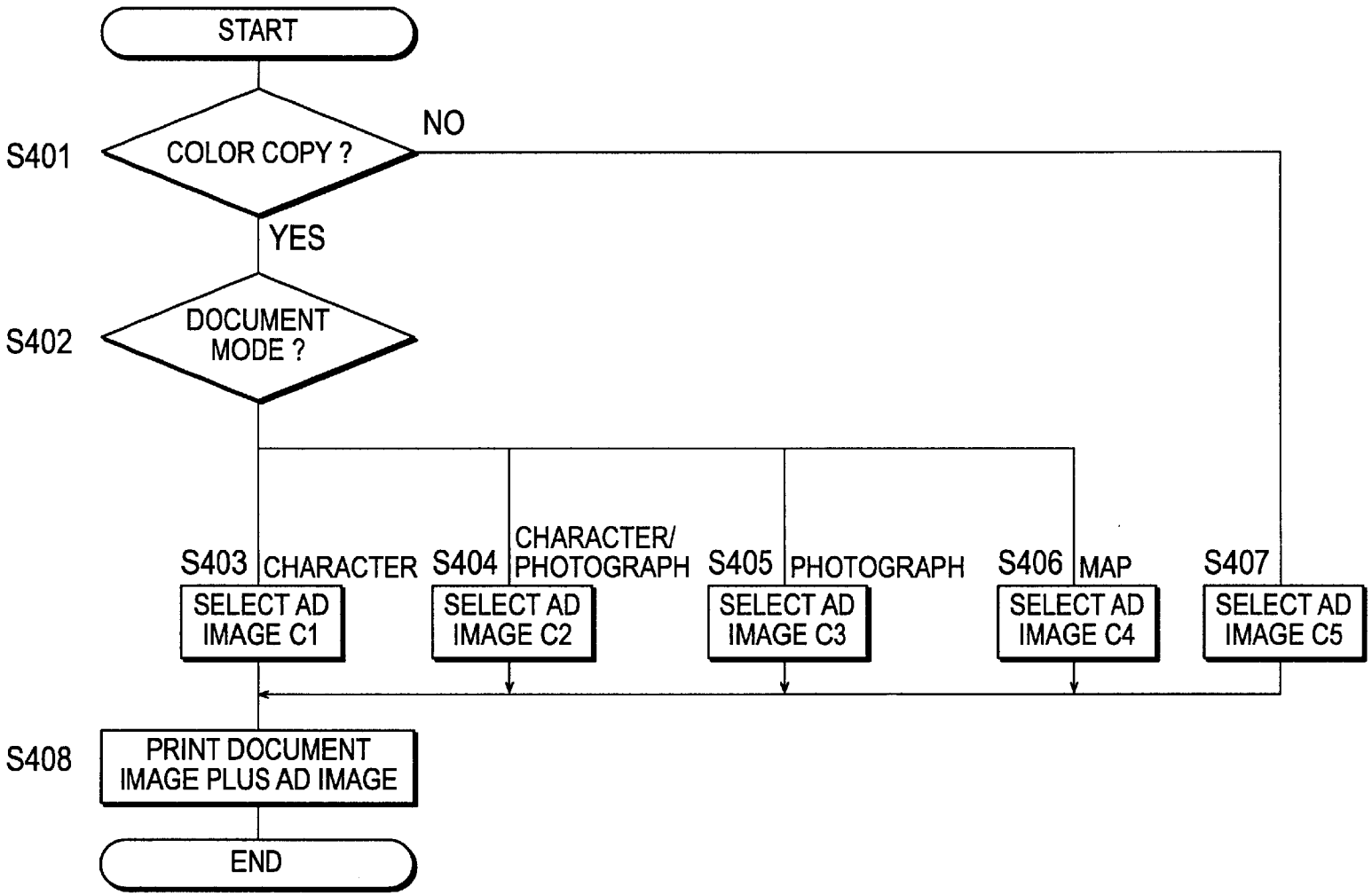
FIG. 8 is a flow chart showing the control procedure for switching the kind of advertisement images according to another detail mode (document mode) of the color copy.

The change control shown in the flow chart of FIG. 8 is another variation of the change control of FIG. 6 and is a case where the kind of advertisement images to be printed (selected) are switched according to a color mode in a broad sense in consideration of another detail mode (document mode) of a color copy in addition to the point whether it is a color copy or monochromatic copy.

In other words, a single advertisement image is automatically selected from a plurality of pre-stored advertisement images according to the selected color mode in case where the color mode that can be set by the user is divided into a color copy mode (four kinds of document mode, i.e., character mode, character/photograph mode, photograph mode, and map mode, are available) and a monochromatic copy mode.

Let us assume that five kinds of advertisement images, for example, an advertisement image for weekly magazines (advertisement image C1), an advertisement image related to foodstuffs (advertisement image C2), a color print advertisement image (advertisement image C3), an advertisement image related to travels (advertisement image C4), and a newspaper advertisement image (advertisement image C5), are pre-stored in the advertisement image memory 26, and the advertisement image to be printed is automatically selected according to the color mode (including the document mode) set by the user as shown in the flow chart of FIG. 8. For example, if the document is a photograph, the user is assumed to be interested in color prints, so that a color print advertisement image (advertisement image C3) is prepared. If the document is a map, the user is assumed to be interested in travels, so that the advertisement image related to travels (advertisement image C4) is prepared.

Rephrasing the above in further details referring to FIG. 8, the basic copying unit 11 first judges whether or not the color mode set by the user is a color copy (S401). If it is a color copy (S401:YES), the contents of its detail mode (document mode) are further judged (S402). If the document mode is found to be the character mode, the advertisement image for weekly magazines (advertisement image C1) is selected (S403); if it is found to be the character/photograph mode, the advertisement image related to foodstuffs (advertisement image C2) is selected (S404); if it is found to be the photograph mode, the advertisement image for color print (advertisement image C3) is selected (S405); and if it is found to be the map mode, the advertisement image related to travels (advertisement image C4) is selected (S406). On the other hand, if the color mode happens to be a monochromatic copy (S401:NO), the advertisement image for newspapers (advertisement image C5) is selected (S407). The advertisement image selected severally in the steps S403–S407 is added to the document image for printing (S408).

If the user's attributes such as age, sex, and profession can be specified to a certain degree by means of the color mode including the document mode as indicated above, the chance of printing an advertisement image suited to each specific user becomes higher and the advertisement effect to the user himself/herself who made a copy can be further enhanced by preparing an advertisement image that matches the user's attributes.

Next, let us describe the latter case (embodiments 5 and 6).

As mentioned above, the copying machine 10 with a charging device can achieve a certain advertisement effect, and it is also effective, if advertisement images can be printed together with a document image being copied, when it is installed, for example, in a convenience store, since it is typically used by a number of unspecified users. If a plurality of advertisement images are stored in advance in the basic copying unit 11 and each user is allowed to select an advertisement image of his/her choice, it should be also beneficial to the user. However, if the number of stored advertisement images is too large, it is troublesome in reality for the user to make a selection if all the stored advertisement images are displayed on the operating panel 18 and it may not be easy to operate. Therefore, if the system automatically selects advertisements to be displayed on the operating panel 18 (selection candidates) so as to make it easy for the user to select an advertisement to a certain degree, still leaving a chance for the user to select an advertisement, it should make it easier for the user to operate and yet provide effectively a more adequate and much larger advertisement effect because the user can select by user's own choice an advertisement image the user really wants. This can be made more effective if the selection of advertisement images useful for the user is made easier in selecting automatically the advertisements to be displayed by changing the selection condition (e.g., choices, order of priority, number of selection) of the advertisements by the user according to the environment (e.g., time, place of installation, copying mode) when the user is making copies.

Therefore, in the embodiments 5 and 6, considering the fact that the copying machine 10 is used by a number of unspecified users, a plurality of advertisement images are stored in the basic copying unit 11 in advance and the contents (kinds) of the advertisements that can be printed are displayed on the operating panel 18, so that the user can select from them a particular advertisement the user wants to print, in order that a maximum advertisement effect can be achieved. Thus, the user can select what he/she really wants. In the meantime, the system automatically selects from the pre-stored advertisement images the selection candidates that seem to be most suitable for the user and displays them on the operating panel 18. In order to further assist the user's selection of a useful advertisement image, the user's advertisement selection conditions, such as, for example, the kind of selection candidates to be displayed on the operating panel 18 (choices of advertisements to be selected by a user), the order of selection candidates displayed on the operating panel 18 in terms of layout (order of priority of advertisements to be selected by a user), and the number of advertisement images that can be actually selected from the selection candidates displayed on the operating panel 18 (selectable number of advertisements to be selected by a user) are changed according to the environment when the user copies the document, such as, for example, copying mode, current time, place of installation of the copying machine 10, and so on. Such user's selection conditions (choices, order of priority, and number of selectable advertisement images) are also displayed on the operating panel 18.

Let us describe in turn the specific examples (embodiments 5 and 6) of the change control of the advertisement contents to be printed or the contents of printable selection candidates to be displayed. The flow charts given below are modifications of the basic flow chart shown in FIG. 3 and any parts that do not need explanations due to the similarities are neither indicated in the drawings nor explained thereon here for the sake of simplicity.

Embodiment 5

Figure 9:
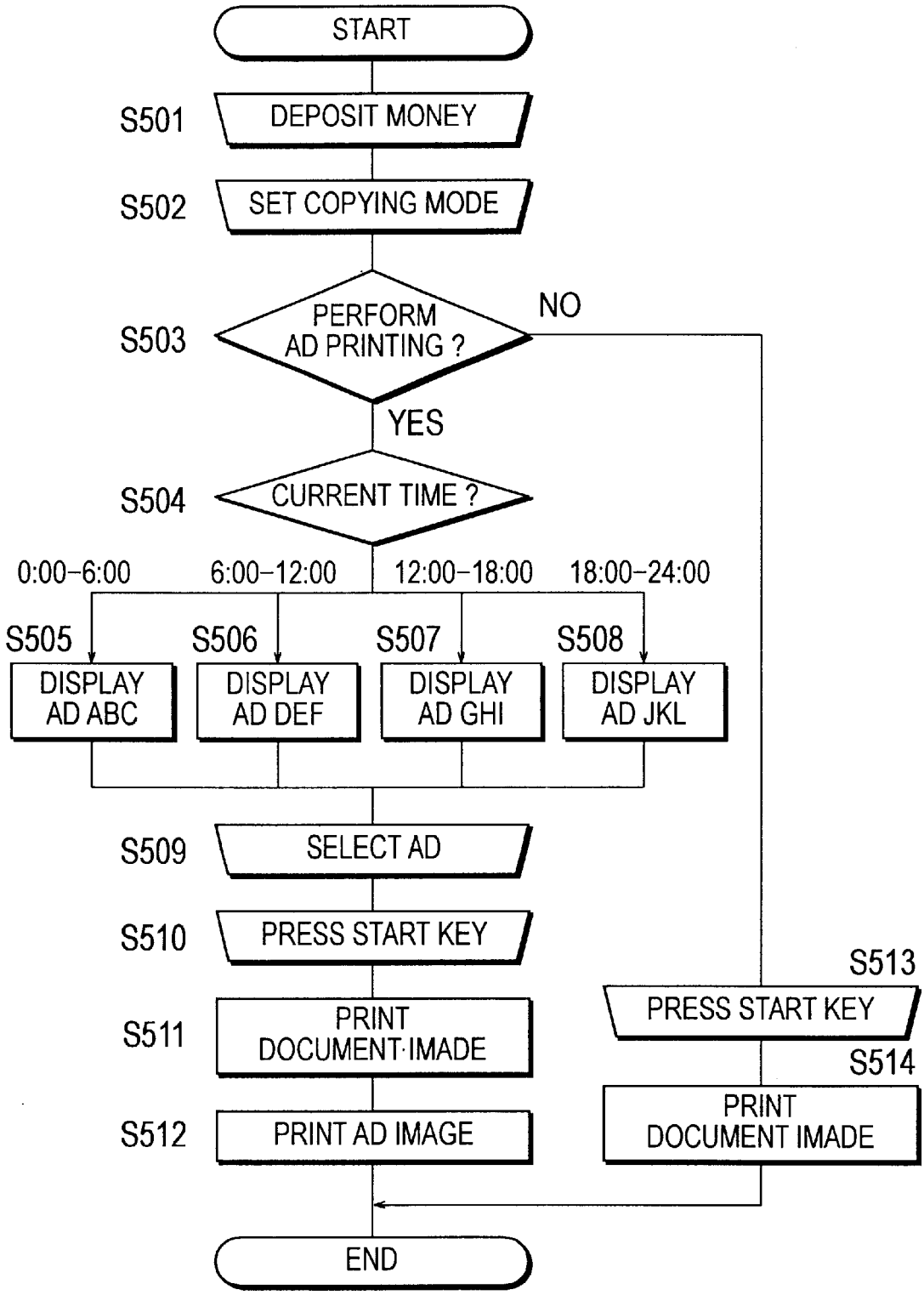
FIG. 9 is a flow chart showing the control procedure for switching the kind of advertisement images to be displayed according to time.

The change control shown in the flow chart of FIG. 9 is a case where the kind of advertisement images to be displayed (selection candidates) are changed according to the time. Let us assume here that the twelve kinds of advertisement images, i.e., advertisements A through L, are stored in advance in the advertisement image memory 26 of the basic copying unit 11.

The user deposits money into the charging device 12 (S501), and sets a desired copying mode on his/her own via the operating panel 18 (S502). At this time, the user can select whether or not any advertisement printing is to be made by operating the keys provided at the advertisement function selecting unit 33.

The basic copying unit 11 judges whether or not any advertisement printing is to be conducted based upon the information set at the step S502 (S503). If advertisement printing is to be conducted due to the user's selection (S503:YES), it proceeds to the step S504; if no advertisement printing is to be conducted (S503:NO), it proceeds to the step S513.

If advertisement printing is to be conducted, the current time is judged based on the information from the clock IC 28 (S504), and the kind of printable advertisements (selection candidates) to be displayed on (the advertisement function selecting unit 33 of) the operating panel 18 are changed according to the current time (S505–S508). For example, if the current time is between 0:00 and 6:00, the advertisements A, B and C are displayed (S505); if it is between 6:00 and 12:00, the advertisements D, E and F are displayed (S506); if it is between 12:00 and 18:00, the advertisements G, H and I are displayed (S507); and if it is between 18:00 and 24:00, the advertisements J, K and L are displayed (S508). The display on the operating panel 18 can be reduced images of the actual advertisement images to be printed on the paper, or descriptions of the advertisement images. By changing the type of advertisements to be displayed according to the current time (time zone), advetisements that are suited to the users can be more easily selected.

The user selects one advertisement the user wants to print from the choices of the printable advertisements displayed according to the time zone (S509), and presses the start key on the operating panel 18 to start the copying operation (S510).

When the copying operation starts, the basic copying unit 11 prints the scanned document image first (S511), and then prints the advertisement image selected at the step S509 (S512). At this time, the advertisement image is printed, according to the user's setting, either on the blank area of the copying paper (blank area advertisement), or the back of the copying paper (backside advertisement), or on a separate sheet of paper from the copying paper (separate sheet advertisement).

On the other hand, if no advertisement printing is to be conducted, the user presses the start key on the operating panel 18 (S513) to initiate the normal document copying operation where only the document image is printed (S514).

Figure 10:
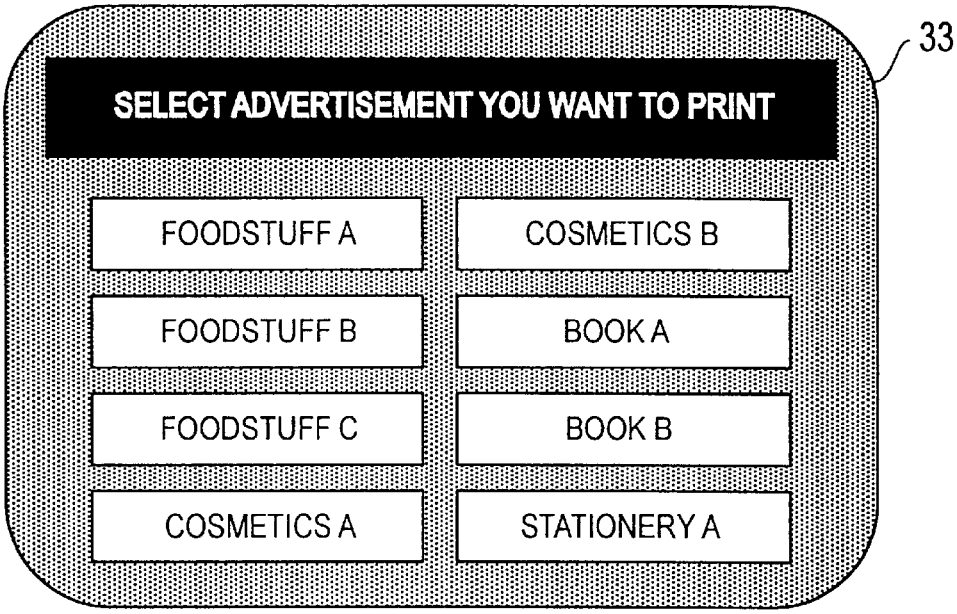
FIG. 10 is a drawing for showing an example of display intended for describing the control shown in FIG. 9.

Moreover, in more specific terms, this embodiment is so designed that the kind of printable advertisement images is displayed using the touch panel type advertisement function selecting unit 33 provided on the operating panel 18 and then the user selects the advertisement he/she wants to print from the displayed contents, as shown in FIG. 10. If there are twenty kinds of advertisement images are stored in the basic copying unit 11 including foodstuff advertisements A–E, cosmetics advertisements A–E, book advertisements A–E, and stationery advertisements A–E, for example, it is impossible to display all of them due to the limited space of the display, and it would make it harder for the user to select if many of them were displayed. Therefore, in this case, eight choices are provided on the display screen.

Figure 11:
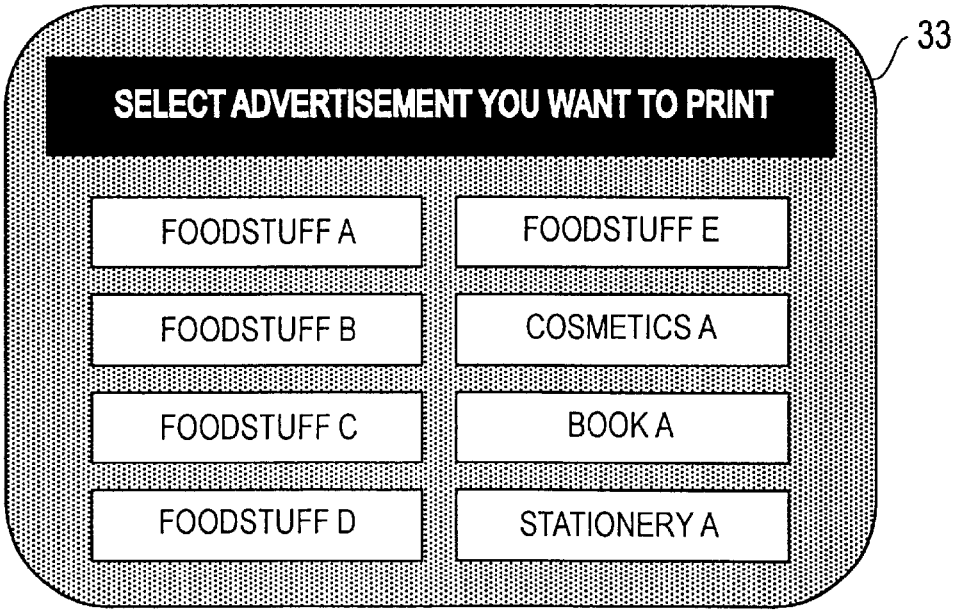
FIG. 11 is a drawing for showing another example of display intended for describing the control shown in FIG. 9.
Figure 12:
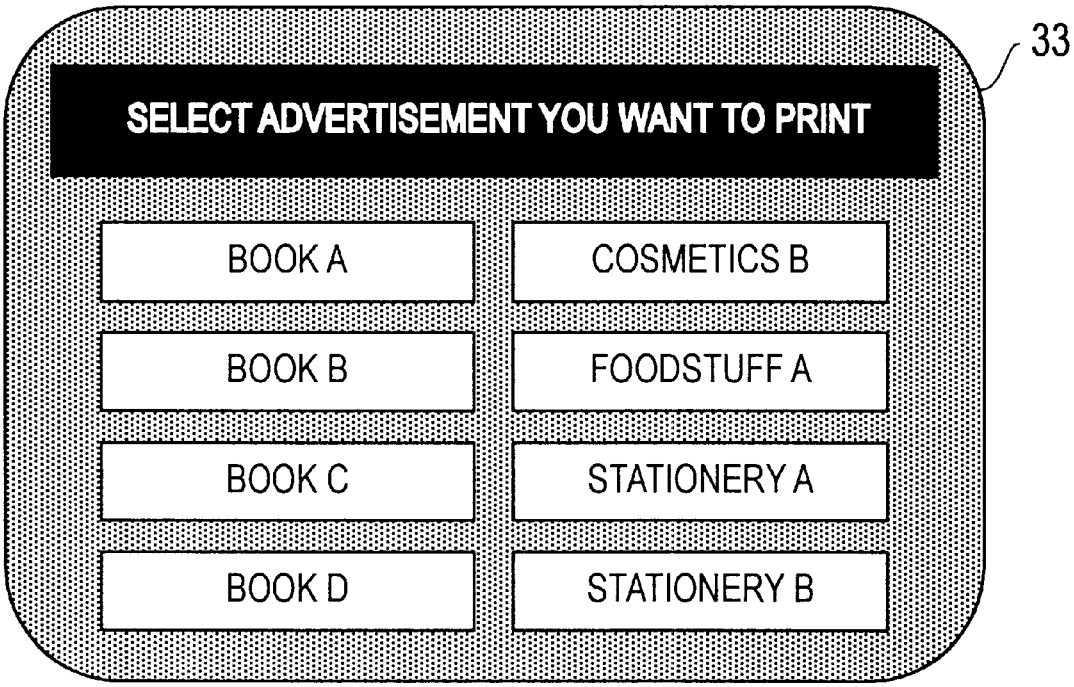
FIG. 12 is a drawing for showing still another example of display intended for describing the control shown in FIG. 9.

In this embodiment, the kind of advertisements to be displayed and selectable by the user is changed according to the time (time zone) when the user is making a copy. For example, the kind of advertisements selectable by the user is changed according to the time zone as shown in FIG. 11 for the morning time zone of 6:00–12:00, and in FIG. 12 for the evening time zone of 18:00–24:00. What is intended here is to increase foodstuff advertisements in the morning hours until noon as more housewives are in the store (see FIG. 11), while more book advetisements are included in the evening hours until midnight as more students come to the store (see FIG. 12).

By changing the kind of printable advertisements to be displayed according to the time, it is possible to offer more advertisement images suited to the users so that they can choose what they really want, thus providing efficiently an appropriate and more substantial advertisement effect.

Embodiment 6

Figure 13:
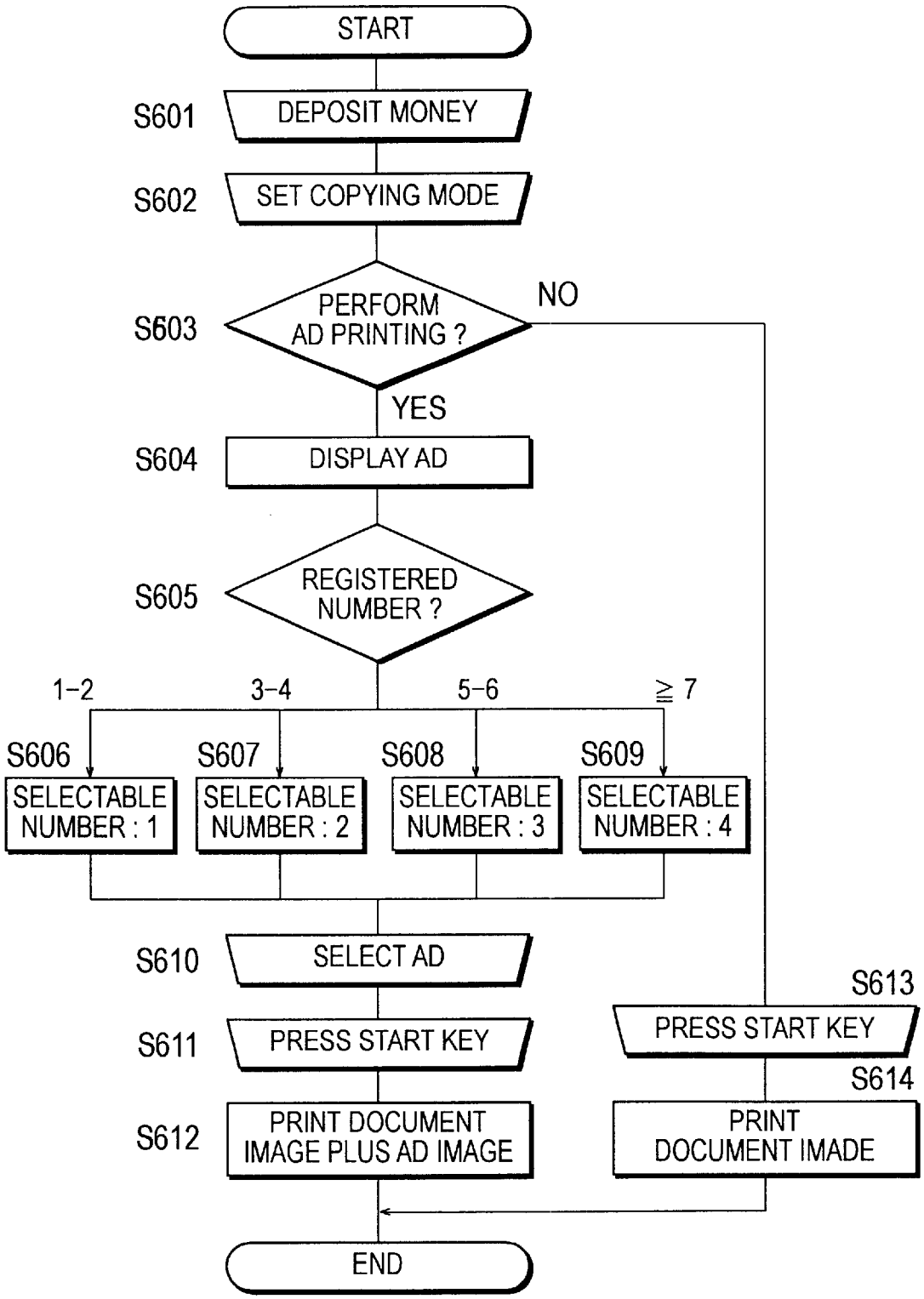
FIG. 13 is a flow chart showing the control procedure for changing the number of advertisement images selectable according to a copying mode.

The change control shown in the flow chart of FIG. 13 is a case where the number of selectable advertisement images is changed according to the copying mode. This change control is particularly suited to the blank area advertisement where the space for advertisement image printing is limited.

The user deposits money into the charging device 12 (S601), and sets a desired copying mode on his/her own via the operating panel 18 (S602). At this time, the user can select whether or not any advertisement printing is to be made by operating the keys provided at the advertisement function selecting unit 33.

The basic copying unit 11 judges whether or not any advertisement printing is to be conducted based upon the information set at the step S602 (S603). If advertisement printing is to be conducted due to the user's selection (S603:YES), it proceeds to the step S604; if no advertisement printing is to be conducted (S603:NO), it proceeds to the step S613.

If advertisement printing is to be conducted, the contents of appropriate plural printable advertisements (selection candidates) selected from a plurality of advertisement images stored in advance in the advertisement image memory 26 are displayed on (the advertisement function selecting unit 33 of) the operating panel 18 (S604).

Then, a judgment is made on the registered number set at the step S602 (S605), and the number of the advertisement images that are selectable is changed according to the set registered number (S606–S609). For example, if the registered number is 1 or 2, the selectable number is set to 1 (S606); if the registered number is 3 or 4, the selectable number is set to 2 (S607); if the registered number is 5 or 6, the selectable number is set to 3 (S608); and if the registered number is not less than 7, the selectable number is set to 4 (S609). The reason why the number of the advertisement images that are selectable is changed according to the registered number is that the number of the advertisement images to be printed must be limited according to the number of the papers on which the user copies since the space available for printing advertisement images is limited if the blank area advertisement is selected as the advertisement printing mode.

Then, the user selects an advertisement/advertisements he/she wants to print from the choices of the displayed printable advertisements within the selectable number determined by the registered number (S610), and presses the start key on the operating panel 18 to start the copying operation (S611). As a result, the document image scanned and the advertisement image/images selected by the user are printed in the blank area advertisement printing format (S612).

On the other hand, if no advertisement printing is to be conducted, the user simply presses the start key on the operating panel 18 (S613), and the system conducts the normal document copying operation where only the document image is printed (S614).

Incidentally, the embodiment 5 shows a case of changing the kind of advertisement images to be displayed according to the time, and the embodiment 6 shows a case of changing the number of advertisement images that are selectable according to the copying mode (registered number), the user's advertisement selection conditions, the conditions for changing these selection conditions, and combination of both are not limited to the above. For example, as mentioned above, the conditions of advertisement selection by the user can be, in addition to the kind of advertisement images to be displayed and the number of selectable advertisement images, the order in terms of layout among a plurality of advertisement images to be displayed (for example, there is a tendency among the users to select an advertisement displayed on the top (foodstuff A or cosmetics B) in case of FIG. 10), and the conditions for changing the selection conditions can be, in addition to the time and the copying mode, a location of the copying machine 10 (e.g., a location close to a hospital or library). As for the combination of the selection conditions and the conditions for changing them, in addition to the embodiments 5 and 6, a case of changing the kind and/or order of advertisement images to be displayed according to the location of the copying machine 10, or a case of changing the order (and/or kind) of advertisement images to be displayed according to the time may be effective. More complex combination of more than three conditions is also possible.

Lastly, let us describe a case (embodiment 7) of considering the user's personal information in each of the former and the latter cases.

In a case of automatically selecting advertisement images to be printed, consideration of the user's personal information such as age and sex makes it possible to automatically select an advertisement image more appropriate to each individual user, so that a higher advertisement effect should be expectable. Such an improvement of advertisement effect due to the consideration of the user's personal information is applicable to the selection of advertisements to be displayed (selection candidates).

Therefore, in the embodiment 7, an advertisement most suitable for each user is automatically selected and printed to further improve the advertisement effect by means of specifying the personal information such as age and sex of the user in the process of automatically selecting advertisement images to be printed, rather than the selection of advertisement images by the user. More specifically, a salesclerk, who has identified the user's personal information (age, sex, profession, etc.), can manually switch advertisement images to be printed by a remote control at a place (e.g., at a cash register of a convenience store, etc.) which is away from the copying machine 10 but from where the salesclerk can still watch a user. Moreover, in case of a copying machine equipped with a charging device that use information storage media such as prepaid cards for payments, it is possible to record thereon the user's personal information in advance when the prepaid cards are sold or issued and to switch advertisement images to be printed based on the user's personal information such as age, sex and profession. Moreover, it is also possible to switch the contents (kinds) of the selection candidates based on the salesclerk's remote control or on the user's personal information entered by information storage media such as prepaid card.

Embodiment 7

Figures 14, 15:
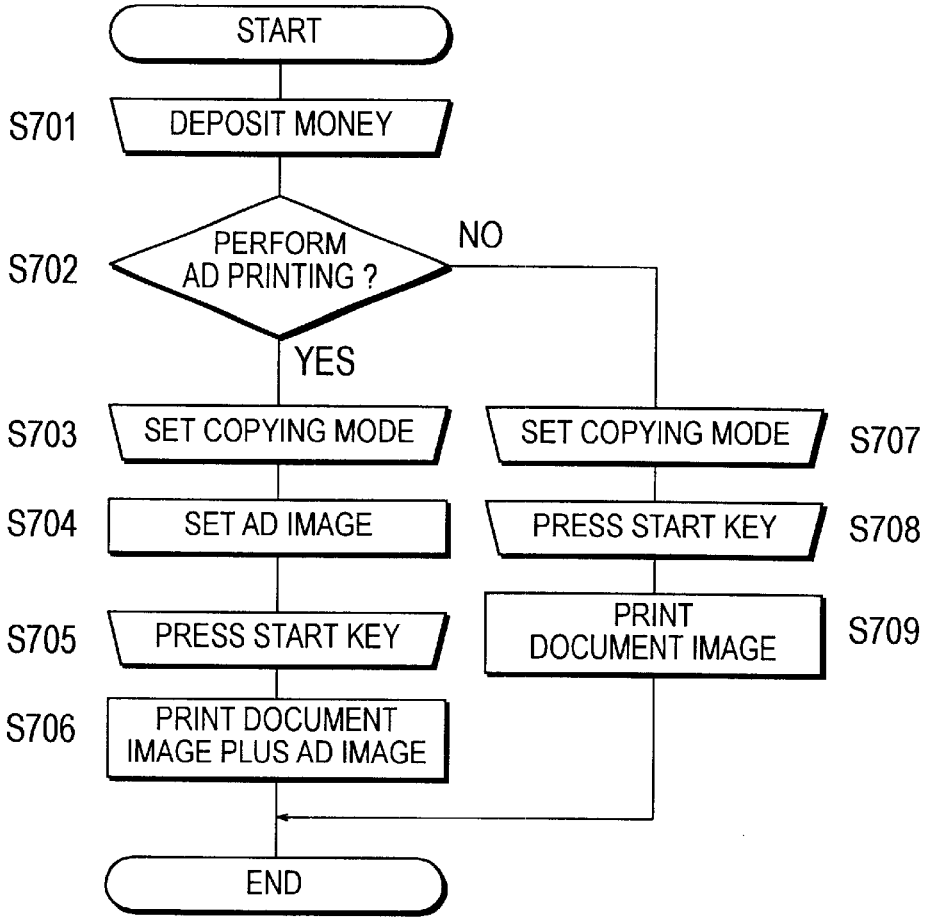
FIG. 14 is a flow chart showing the control procedure for changing the kind of advertisement images to be displayed according to a remote control or personal information prerecorded in a prepaid card.
FIG. 15 is a table showing an example of automatically selecting the advertisement image according to user's age and sex.

The change control shown in the flow chart of FIG. 14 is a case where the kind of advertisement images to be displayed are changed by means of a remote control or based on personal information prerecorded on a prepaid card.

The user deposits money into the charging device 12 (S701), and selects whether or not any advertisement printing is to be performed by operating the keys provided at the advertisement function selecting unit 33 of the operating panel 18 (S702). If advertisement printing is to be conducted (S702:YES), it proceeds to the step S703; if no advertisement printing is to be conducted (S702:NO), it proceeds to the step S707.

If advertisement printing is performed with the charge deposited in coin, while the user is setting a copying mode via the operating panel 18 (S703), the salesclerk changes the kind of advertisement images to be displayed (selection candidates) operating the terminal 50 located at a place away from the copying machine 10, for example, at a cash register of a convenience store, judging the user's age, sex, profession, and so on (S704). Incidentally, this can be modified in such a way that an advertisement image to be printed is automatically selected as the salesclerk enters the user's age, sex, and so on, into the terminal 50 when the user selected the advertisement printing.

If advertisement printing is performed with the charge paid by the prepaid card, when the user has set a copying mode via the operating panel 18 (S703), the kind of advertisement images to be displayed (selection candidates) is changed based on the user's personal information, such as age, sex, and profession, prerecorded on the prepaid card (S704). Incidentally, this can also be modified in such a way that an advertisement image to be printed is automatically selected according to the information such as user's age, sex, and so on, prerecorded on the prepaid card when the user selected the advertisement printing.

When the user presses the start key on the operating panel 18 (S705), the selected advertisement image is added to the scanned document image for printing (S706). At this time, the advertisement image is printed on the blank area or backside of the copying paper, or on a separate sheet according to the user's setting.

If no advertisement printing is to be performed, the user sets a copying mode (S707) and presses the start key on the operating panel 18 (S708), which results in the normal document copying operation where only the document image is printed (S709).

FIG. 15 is a table showing an example of automatic selection of the advertisement image according to the user's age and sex.

Here, the kind of advertisement images is classified according to the user's age and sex, as can be seen from the table, and an advertisement image to be printed is automatically selected as the user's information about age and sex is entered by a remote control of a salesclerk or by personal information prerecorded on a prepaid card. For example, a cosmetics advertisement for a young woman and an automobile advertisement for a young man are allocated.

What is claimed is:

1. Image forming apparatus, comprising:

a selecting unit for selecting a condition from a plurality of conditions;

a memory for storing a plurality of additional images;

a control unit for outputting from said memory an additional image in accordance with the selected condition; and an image forming unit for forming an image by adding the outputted additional image to a document image.

2. Image forming apparatus of claim 1, wherein said control unit, when the set number of sets is plural, outputs from said memory a different additional image every time a document image to be image-formed is exchanged.

3. Image forming apparatus of claim 1, wherein said control unit outputs from said memory an additional image in accordance with a selected color mode.

4. Image forming apparatus of claim 3, wherein said control unit, when a color output is selected as a color mode, outputs from said memory an additional image in accordance with a function mode further selected from a function mode that can be set in case of the color output.

5. Image forming apparatus of claim 3, wherein said control unit, when a color output is selected as a color mode, outputs from said memory an additional image in accordance with a document mode further selected from a document mode that can be set in case of the color output.

6. Image forming apparatus, comprising:

a memory for storing a plurality of additional images;

a display unit for displaying information corresponding to part of additional images of the plurality of additional images stored in said memory;

a selection unit for making a user select an additional image to be image-formed from the part of additional images based on the displayed information;

an image forming unit for forming an image by adding the selected additional image to a document image; and a changing unit, in accordance with a condition when the document image is image-formed, for changing a selection condition when the user is made to select the additional image, wherein the additional image corresponds to an advertisement image.

7. Image forming apparatus comprising:

a memory for storing a plurality of additional images;

a display unit for displaying information corresponding to part of additional images of the plurality of additional images stored in said memory;

a selection unit for making a user select an additional image to be image-formed from the part of additional images based on the displayed information;

an image forming unit for forming an image by adding the selected additional image to a document image; and a changing unit, in accordance with a condition when the document image is image-formed, for changing a selection condition when the user is made to select the additional image.

8. Image forming apparatus of claim 7, wherein said condition is an environment when the document image is image-formed.

9. Image forming apparatus of claim 8, wherein said environment is a copying mode.

10. Image forming apparatus of claim 8, wherein said environment is the current time.

11. Image forming apparatus of claim 8, wherein said environment is a place where said apparatus is installed.

12. image forming apparatus of claim 7, wherein said selection condition is the kind of the part of additional images corresponding to the information displayed on said display unit.

13. Image forming apparatus of claim 7, wherein said selection condition is the order of the part of additional images corresponding to the information displayed on said display unit.

14. Image forming apparatus of claim 7, wherein said selection condition is the number of additional images that can be selected from the part of additional images corresponding to the information displayed on said display unit.

15. Image forming apparatus, comprising:

a memory for storing a plurality of additional images;

an accepting unit for accepting user information for selecting an additional image to be image-formed from the plurality of additional images stored in said memory; and an image forming unit for forming an image by adding to a document image the additional image selected based on the accepted user information.

16. Image forming apparatus of claim 15, wherein said user information is age of a user.

17. Image forming apparatus in accordance with the claim 15, wherein said user information is sex of a user.

18. Image forming apparatus in accordance with the claim 15, wherein said user information is a profession of a user.

19. Image forming apparatus, comprising:

a memory for storing a plurality of additional images;

an accepting unit for accepting user information for displaying information corresponding to part of additional images of the plurality of additional images stored in said memory;

a display unit for displaying the information based on the accepted information;

a selection unit for making a user select an additional image to be image-formed from the part of additional images based on the displayed information; and an image forming unit for forming an image by adding the selected additional image to a document image.

20. Image forming apparatus of claim 19, wherein said user information is age of the user.

21. Image forming apparatus of claim 19, wherein said user information is sex of the user.

22. Image forming apparatus of claim 19, wherein said user information is a profession of the user.

* * * * *